US007238106B2

(12) United States Patent
Scott

(10) Patent No.: US 7,238,106 B2
(45) Date of Patent: Jul. 3, 2007

(54) AIR DELIVERY SYSTEM

(76) Inventor: James L. Scott, 11304 W. 99th Pl., Overland Park, KS (US) 66214

( * ) Notice: Subject to any disclaimer, the term of this patent is extended or adjusted under 35 U.S.C. 154(b) by 0 days.

(21) Appl. No.: 10/991,588

(22) Filed: Nov. 18, 2004

(65) Prior Publication Data

US 2005/0121534 A1 Jun. 9, 2005

Related U.S. Application Data

(60) Provisional application No. 60/524,800, filed on Nov. 25, 2003.

(51) Int. Cl.
*F24F 13/06* (2006.01)

(52) U.S. Cl. ..... 454/306; 454/903

(58) Field of Classification Search ..... 454/333, 454/903, 306; 237/11, 46
See application file for complete search history.

(56) References Cited

U.S. PATENT DOCUMENTS

| | | | | | |
|---|---|---|---|---|---|
| 718,928 | A | * | 1/1903 | Hammond et al. | 454/333 |
| 760,182 | A | * | 5/1904 | Chapman et al. | 454/333 |
| 1,466,093 | A | * | 8/1923 | Erb | 237/1 R |
| 2,115,482 | A | * | 4/1938 | Crewe | 128/205.12 |
| 2,140,829 | A | * | 12/1938 | Child | 62/97 |
| 2,282,210 | A | * | 5/1942 | Plum | 454/255 |
| 2,385,682 | A | * | 9/1945 | Burkholder, Jr. | 119/304 |
| 2,516,381 | A | | 7/1950 | Grebe | |
| 2,595,408 | A | * | 5/1952 | Quest | 405/40 |
| 2,835,186 | A | * | 5/1958 | Goldsmith | 454/306 |
| 2,863,606 | A | * | 12/1958 | Tatsch | 237/69 |
| 3,289,313 | A | | 12/1966 | Lechner, Jr. et al. | |
| 3,865,181 | A | | 2/1975 | Mori et al. | |
| 3,881,402 | A | * | 5/1975 | Larkfeldt | 454/305 |
| 4,150,788 | A | | 4/1979 | Matsumoto | |
| 4,258,615 | A | * | 3/1981 | Vivian | 454/229 |
| 4,300,441 | A | | 11/1981 | Dicks | |
| 4,351,475 | A | * | 9/1982 | Hudson | 237/46 |
| 4,364,512 | A | | 12/1982 | Morrison | |
| 4,473,060 | A | | 9/1984 | Bangerter | |
| 4,477,020 | A | * | 10/1984 | Makara | 236/49.3 |
| 4,497,999 | A | * | 2/1985 | Postbeschild | 392/381 |
| 4,589,331 | A | | 5/1986 | Villamagna et al. | |
| 4,662,269 | A | * | 5/1987 | Tartaglino | 454/255 |
| 4,735,235 | A | * | 4/1988 | Anderson et al. | 138/109 |
| 4,735,579 | A | | 4/1988 | Muser | |
| 4,775,001 | A | * | 10/1988 | Ward et al. | 165/214 |
| 4,829,626 | A | | 5/1989 | Harkonen et al. | |
| 4,873,773 | A | | 10/1989 | Canonge | |
| 5,107,603 | A | * | 4/1992 | Durazzani | 34/91 |
| 5,123,595 | A | * | 6/1992 | Doss | 237/46 |
| 5,219,403 | A | * | 6/1993 | Murphy | 137/561 A |
| 5,263,502 | A | | 11/1993 | Dick | |
| 5,271,558 | A | | 12/1993 | Hampton | |
| 5,274,878 | A | | 1/1994 | Radabaugh et al. | |
| 5,277,468 | A | | 1/1994 | Blatt et al. | |
| 5,360,374 | A | * | 11/1994 | Wyon et al. | 454/306 |
| 5,370,578 | A | * | 12/1994 | Yi | 454/305 |

(Continued)

*Primary Examiner*—Derek S Boles
(74) *Attorney, Agent, or Firm*—Polsinelli Shalton Flanigan Suelthaus PC

(57) ABSTRACT

The present invention relates to a system for delivering temperature and flow rate controlled warmed air to outlets for use in various apparatus. The system is typically in residential structures, such as homes, but could easily be adapted for apartment buildings as well as commercial buildings.

28 Claims, 6 Drawing Sheets

U.S. PATENT DOCUMENTS 5,387,117 A 2/1995 Moyher, Jr. et al.
5,438,763 A 8/1995 Yang
5,458,586 A 10/1995 Adiletta
5,486,140 A * 1/1996 Abbott et al. ..... 454/333
5,526,842 A 6/1996 Christensen
5,551,117 A 9/1996 Bamman
5,833,134 A * 11/1998 Ho et al. ..... 236/49.3
5,938,061 A 8/1999 Ward et al.
6,117,005 A * 9/2000 Weiss ..... 454/202
6,218,798 B1 4/2001 Price et al.
6,318,113 B1 * 11/2001 Levy et al. ..... 62/426
6,402,613 B1 * 6/2002 Teagle ..... 454/195
6,431,457 B1 * 8/2002 Dirkes, II ..... 236/11
6,443,393 B1 * 9/2002 Ooi et al. ..... 244/118.5
6,837,786 B2 * 1/2005 Linde et al. ..... 454/256
6,902,473 B1 * 6/2005 Goobeck ..... 454/127
6,942,563 B2 * 9/2005 Pesch et al. ..... 454/152

* cited by examiner

AIR DELIVERY SYSTEM

CROSS-REFERENCES TO RELATED APPLICATIONS

This application is related to and claims priority from U.S. Provisional Patent Application Ser. No. 60/524,800, entitled: AIR DELIVERY SYSTEM, filed Nov. 25, 2003. U.S. Provisional Patent Application Ser. No. 60/524,800 is incorporated by reference herein.

FIELD OF THE INVENTION

The present invention is directed to systems and methods for delivering warmed air to various points in a structure at various temperatures and flow rates.

BACKGROUND OF THE INVENTION

Residential construction in the U.S. is continuing at a record pace, with over one million new homes built in the U.S. in 2003. This robust growth in new housing is expected to continue beyond 2004.

With the growth of the home building industry, comes growth in segments of the industry, such as upscale homes. These homes typically have central heating and air conditioning systems, and in many of these homes, a central vacuum system. These homes also include numerous upgrades, such as whirlpools, saunas, steam rooms, professional kitchens, and the like. Additional systems are constantly being sought to increase the homeowner's comfort and enjoyment of their residential unit.

SUMMARY OF THE INVENTION

The present invention relates to a system for delivering temperature and flow rate controlled warmed air to outlets for use in various apparatus. The system is typically a central system in residential structures, such as homes, but could easily be adapted for apartment buildings as well as commercial buildings.

An embodiment of the invention is directed to a system for delivering warmed air in a structure, for example, a house. The system includes a unit for producing and driving warmed air from the unit, and at least one port, typically multiple ports, for receiving the warmed air. The ports are such that they can be coupled with an apparatus that receives the warmed air. There is also at least one conduit, typically multiple conduits, coupled to the warmed air producing unit and the ports, the at least one conduit provides for the transport of warmed air, from the unit to the at least one port.

Another embodiment of the invention is also directed to a system for delivering warmed air in a structure. The system includes a unit for blowing and tempering air at adjustable flow rates and temperatures and at least one port, typically multiple ports, for receiving the blown and tempered air, the at least one port such that it supplies the blown and tempered air to an apparatus that utilizes the blown and tempered air. There is also at least one conduit, coupled with the air blowing and tempering unit and the at least one port. The at least one conduit functions to provide a pathway for the blown and tempered air from the air blowing and tempering unit to the at least one port.

Another embodiment of the invention is directed to an air delivery system. The system includes a unit for producing tempered air and driving the tempered air out of the unit. There is also at least one outlet, and typically multiple outlets, and at least one conduit coupled with the air tempering and driving unit and the at least one outlet. A controller functions to control the air tempering and driving unit. The controller is such that it is electronically linked to at least one control device for signaling the controller to control the air tempering and driving unit, such that air is delivered to the at least one outlet, at a temperature and a flow rate corresponding approximately to the air temperature and flow rate designated at the at least one control device. The at least one control device may be, for example, a fixed control panel or a remote controller, and is such that it is used to control air temperature and flow rates to one or more outlets.

Another embodiment of the invention is directed to a method for delivering air to a remote location. The method includes heating air to at least a predetermined temperature, and driving the heated air to at least one port at a predetermined flow rate. The at least one port is such that it can be coupled with an apparatus that receives the heated air at least at approximately the predetermined flow rate and approximately the predetermined temperature. The at least one port is typically proximate to the remote location and may be the remote location. The apparatus utilizes the heated and controlled flow rate air for one or more functions.

BRIEF DESCRIPTION OF DRAWINGS

Attention is now directed to the drawing figures, where corresponding or like numerals indicate corresponding or like components. In the drawings.

DETAILED DESCRIPTION

The present invention relates to a system for air delivery to remote locations in a structure, such as a house or the like. The air delivery system is centralized, and provides warmed air to various outlets in the house from an air warming and blowing unit. Structures, alone or that serve as supply lines to apparatus that utilize the warmed air, can be placed into the outlets to receive the warmed air for various functions. The temperature of the warmed air and flow rate in cubic feet per minute (CFM) of the warmed air is adjustable and can be controlled for each outlet, either with a remote controller or fixed control panel for each individual outlet, or from a master (fixed) control panel, or master remote controller, through which air delivery through all of the outlets (to apparatus) may be individually controlled. The system includes a central warm air source controlled by a control system (controller), for example, computer control, processor (microprocessor) control, and related control circuitry, or other similar control. The control system is electronically linked to fixed control panels or remote controllers.

Figure 1:
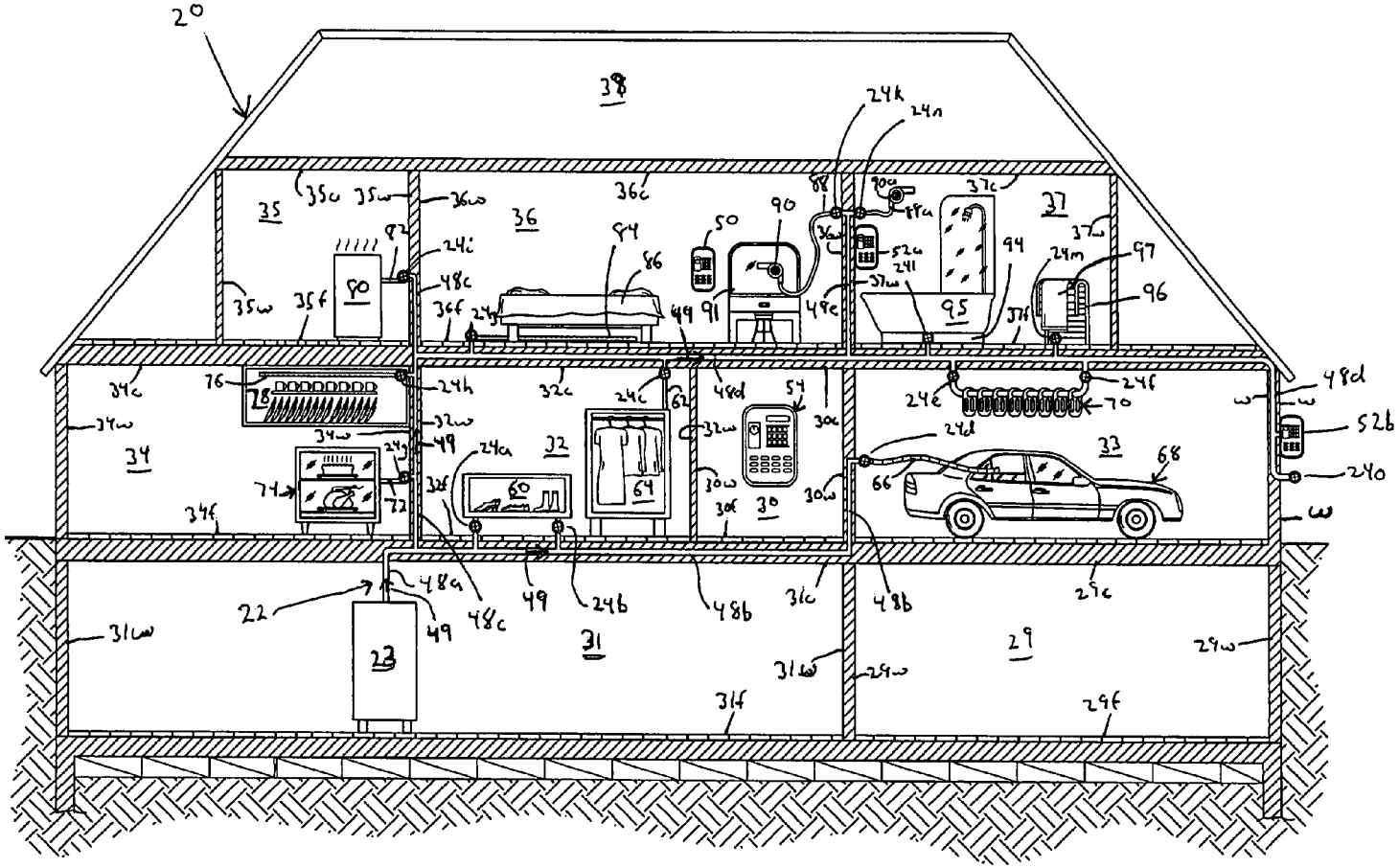
FIG. 1 is a diagram of a house employing an exemplary system in accordance with an embodiment of the invention.

FIG. 1 shows a house 20, showing the air delivery system 22 of the invention in an exemplary operation. The air delivery system 22 is preferably designed to deliver warmed air, for example, at temperatures of approximately 90° Fahrenheit (F) to 170° F., with adjustibility of approximately ±10° F. The warmed air is delivered from an air warming and blowing unit 23 to various outlets 24*a*–24*o*, located in various rooms 29–38 of the house 20. The rooms 29–38 have walls, indicated by the room number with a "w", floors, indicated by a room number with an "f", and ceilings, indicated by a room number with a "c". For example, the laundry room 32, has walls 32*w*, a floor 32*f* and a ceiling 32*c*. Walls in rooms not shown, for example, the door of the garage is not shown, so the walls w behind the garage door, are indicated as "w".

The system 22 includes an air warming and blowing unit 23 that provides warmed air to the outlets 24*a*–24*o* through a series of connected conduits 48*a*–48*e*. The air travels from the air warming and blowing unit 23, through the conduits 48*a*–48*e*, to the outlets 24*a*–24*o*, in the direction of the arrows 49.

At each outlet 24*a*–24*o*, the air warming and blowing unit 23 can be controlled, such that the warmed air is temperature controlled and the air flow rate is controlled (adjustable) for each outlet. Control of the air temperature and air flow rate from the air warming and blowing unit 23 is through one or more of, remote controllers 50 (only one shown) for one or more specific outlets, fixed control panels, for one or more specific outlets, such as fixed control panels 52*a*, 52*b*, one or more master control panels, such as the single master control panel (master controller) 54, or a master remote controller 56 (similar to the master control panel 54, but in the form of a remote controller). The remote controllers 50, fixed control panels 52*a*, 52*b*, master control panel 54 and master remote controller 56 are collectively referred to herein as "control devices."

All of the aforementioned control devices are electronically linked, by wired or wireless links, or combinations thereof, to the controller 152 (detailed below), that controls the air warming and blowing unit 23, detailed below. Direct electronic links between any of the control devices and the components of the air warming and blowing unit 23 are also permissible.

Additionally, while various outlets 24*a*–24*o* are shown as controlled by various control devices, this is exemplary only, as any of the outlets 24*a*–24*o* may be controlled by one or more of the aforementioned control devices. The control devices are all programmable, such that the user can select the outlets, that are to be controlled by the desired control device or control devices.

The control devices can also be configured such that if two outlets are potentially controllable by two control devices, a hierarchy among the control devices can be established. For example, the master control panel 54 or master remote controller 56, typically has hierarchy over remote controllers, such as the remote controller 50 or the fixed control panels 52*a*, 52*b*. The control devices can interface with computer type devices and other processor controlled devices, so as to be programmable over cellular networks, wide area networks, such as the Internet or local area networks (LANs).

The remote controllers, such as remote controller 50, and the fixed control panels, such as fixed control panels 52*a* and 52*b*, are typically specific to one, but in some cases is specific to two or more outlets, for example, when a single apparatus draws from two or more outlets, or for controlling grouped outlets supporting different apparatus. This remote controller 50 is detailed in FIG. 8, described below. Fixed control panels 52*a*, 52*b* are similar in all aspects to the remote controllers, but may employ both wired and/or wireless links for controlling air temperature and air flow rate from the air warming and blowing unit 23.

Figure 9:
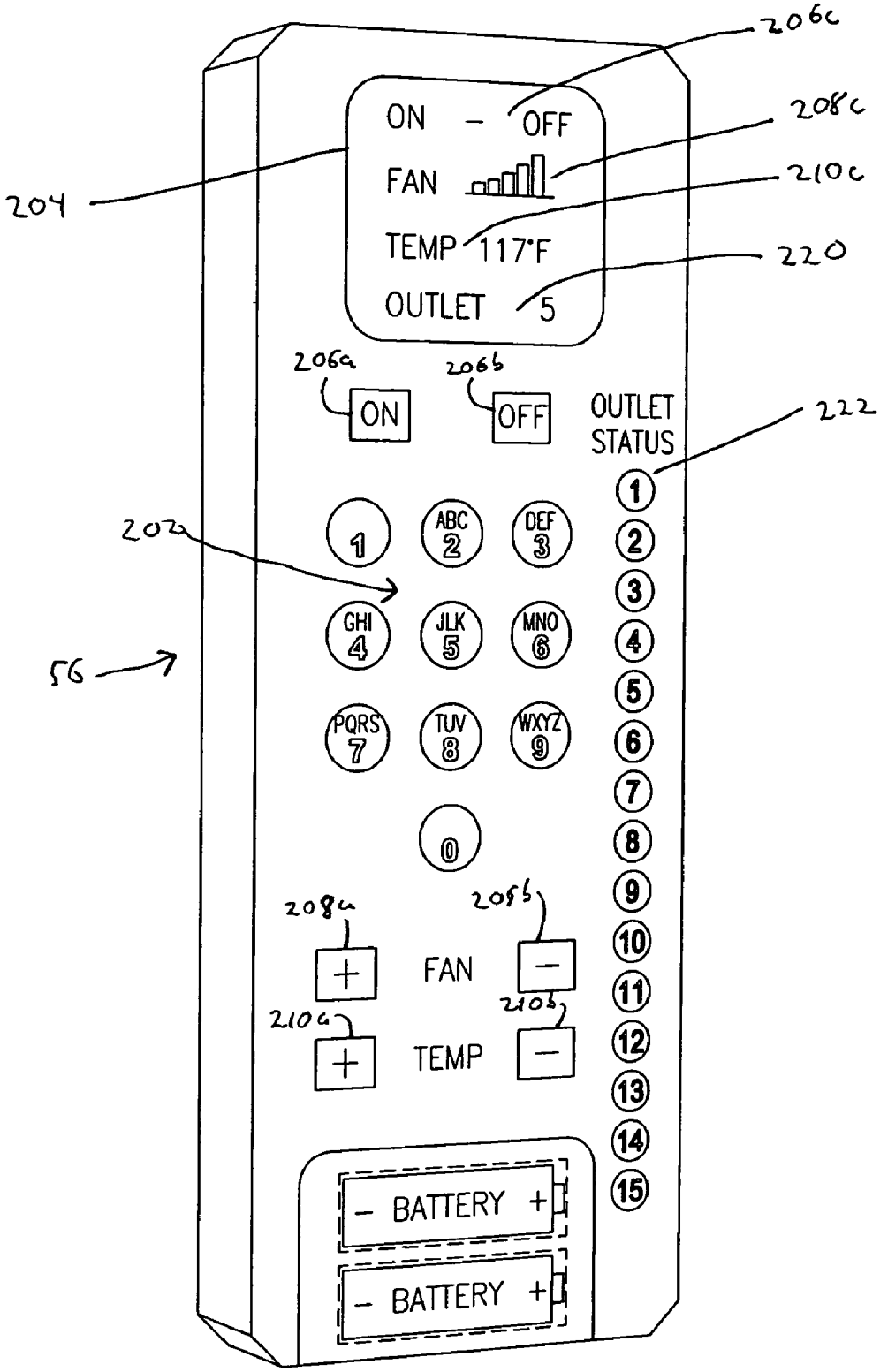
FIG. 9 is a perspective view of a master remote controller in accordance with an embodiment of the invention.

The master control panel (master controller) 54 is typically affixed to a wall in a centralized location in the house, for example, a basement utility room 29 or a utility room 30 as shown. Through the master control panel 54, the air temperature and flow rate can be controlled for all of the individual outlets 24*a*–24*o*, or a master remote controller 56, that functions similar to that of the master control panel 54, but is a remote controller, and is shown in FIG. 9 below.

The outlets 24*a*–24*o*, are shown, for example, in use with various apparatus (devices) in various rooms of the house 20. The air warming and blowing unit 23 is typically located in the basement 31 of the house, where the furnace unit is typically located. A conduit 48*a* extends from this air warming and blowing unit 23, and branches into conduits 48*b* and 48*c*. Conduit 48*d*, extends from conduit 48*c*, and conduit 48*e* extends from conduit 48*d*. The aforementioned conduits 48*a*–48*d* allow for the transport of the warmed air form the air warming and blowing unit 23 to the respective outlets 24*a*–24*o* (in the direction of the arrows 49).

Outlets 24*a* and 24*b*, located in the laundry room 32, receive warmed air through the conduit 48*b*. These outlets 24*a* and 24*b* are shown supporting a shoe dryer or shoe warmer 60, that connects (attaches) directly to the outlets 24*a*, 24*b*, as the apparatus, the shoe warmer 60, includes tubular structures for receipt in the outlets 24*a*, 24*b*. Alternately, the shoe dryer or shoe warmer 60, as well as other apparatus described herein, that are "directly connected" to their respective outlet(s), can be connected through connector hoses, detailed below. Also in this room 32, outlet 24*c*, that receives warmed air from the conduit 48*d*, connects, typically by a line 62, to a drying/warming closet 64.

Outlet 24*d*, located in the garage 33, receives warmed air through the conduit 48*b*. This outlet 24*d* supports a line 66, that is used to warm the interior of an automobile 68. The line 66, or a different line (when connected to the outlet 24*d*), can be used as a pet bed warmer, refrigerator/freezer defroster, pipe warmer/defroster for frozen pipes, and, if of sufficient length, can be used outside of the garage 33 to melt snow, ice and the like. Also in the garage 33, outlets 24*e* and 24*f*, receive warmed air through the conduit 48*c*, and a room warmer 70 connects (attaches) directly to these outlets 24*e*, 24*f*.

Outlets 24*g*, 24*h*, located in the kitchen 33, receive warmed air through the conduit 48*c*. Outlet 24*g*, supports a line 72, that connects to a food warmer 74, while outlet 24*h*, supports a line 76, that connects directly into the outlet 24*h* and extends inside a dish warmer and dryer 78. Conduit 48*c* terminates at outlet 24*i*, in a closet 35, that has a clothes warmer 80, that connects to the outlet 24*i*, through a line 82.

Conduit 48*d*, extends from conduit 48*c*, and supports the outlet 24*j* in the bedroom 36. The outlet 24*j*, supports a line 84, that connects directly into the outlet 24*j* and is placed under the bed 86 to server as a bed warmer. Also in the bedroom 36 is an outlet 24*k*, from the conduit 48*e* (that extends from conduit 48*d*), that attaches to a line 88 for a hair dryer 90 or other similar appliance. The hair dryer 90, can be such that it sits on a dressing table or vanity 91. The hair dryer 90, for example, may be controlled by the remote controller 50, exemplary of remote controllers suitable for controlling any of the outlets (here, for example, single or paired depending on the apparatus being supported) described herein.

Conduit 48*d* supports the outlets 24*l* and 24*m*, in the master bedroom bathroom 37. A tub/shower floor warming unit 94 attaches directly to the outlet 24*l*, for warming a tub/shower 95. A towel warming rack 96 attaches directly to the outlet 24*m*, for warming towels 97 and the like. Outlet 24*n*, that receives warmed air from conduit 48*e*, connects to a line 88*a* for a hair dryer 90*a*, or other similar appliance. The hair dryer 90*a* may be a wall mounted hair dryer. The hair dryer 90*a*, for example, may be controlled by a fixed control panel 52*a*, exemplary of fixed controllers suitable for controlling one or more outlets (here, for example, single, paired or otherwise grouped, depending on the apparatus being supported) described herein.

While outlets 24*a*–24*o* are shown throughout the house 20, any number of outlets in any number of rooms, including the attic 38, controllable by any of the control devices detailed above, is also permissible. Additionally, the master control panel 54 can be linked to a network, such as the Internet or a local area network (LAN), as well as a cellular network, to be controlled by computers, on site or remote, or by a cellular telephone or other device capable of accessing the cellular network, the Internet, or the LAN. The master control panel 54 can also be such that it is linked (electronically) and coordinated with other house functionalities, such as alarm systems, electrical system controllers, and the like.

Conduit 48*d* terminates in one or more external outlets 24*o* (only one shown), at locations on the exterior of the house 20. For example, lines (not shown) may be connected to the outlet(s) 24*o* to bring warmed air to desired locations, for applications such as ice and snow melting. The external outlet(s) 24*o*, are shown, for example, as controlled by the fixed control panel 52*b*.

As stated above, the conduits 48*a*–48*d* are all interconnected and they are, for example, within the areas between the walls, floors and ceilings, under the floors or above the ceilings. The conduits 48*a*–48*e* are of piping suitable for carrying warmed air. For example, the majority of the piping may be approximately three inches (approximately 7.6 cm) in diameter with piping extending between the walls of the closet 35 and the bedroom 36, the bedroom 36 and the bathroom 37, and the utility room 30 and the garage 33, may be approximately two inches (approximately 5.1 cm) in diameter. This piping may be, for example, Chlorinated Poly (Vinyl Chloride) (CPVC) or galvanized metal piping, able to withstand temperatures up to approximately 210° Fahrenheit (approximately 98.9° Celsius). The piping is such that pipes that form it, and accordingly, the conduits 48*a*–48*e*, are joined together by conventional pipe fitting and joining techniques, including the use of expansion joints where necessary (depending on the particular structure).

The piping is typically insulated on its outside. Insulation may be, for example, polyethylene foam, approximately two inches (approximately 5.1 cm) thick, that "snaps on" to the respective pipes.

Figure 2:
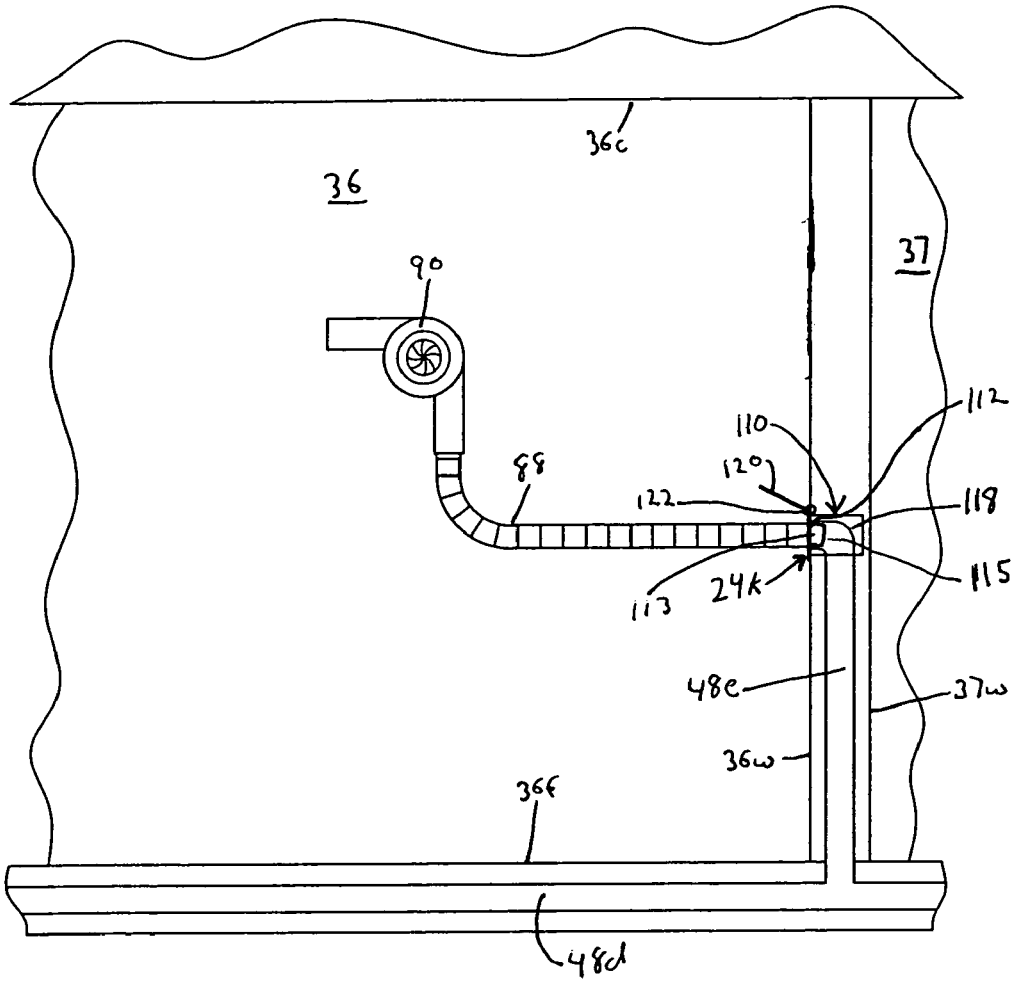
FIG. 2 is a detailed view of an outlet in a room of the house of FIG. 1.
Figure 3:
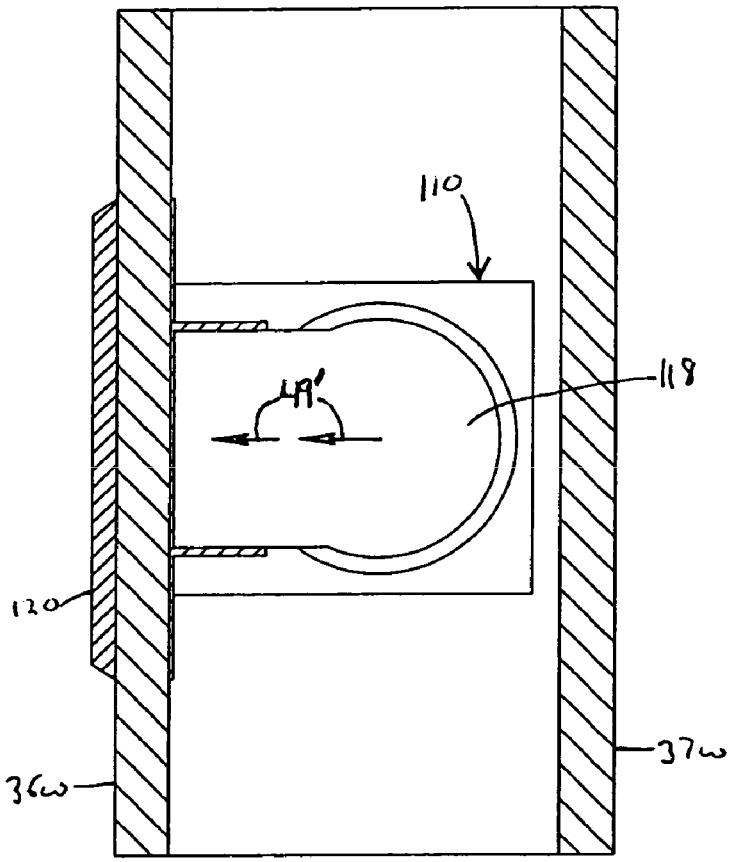
FIG. 3 is a top view of the outlet of FIG. 2.
Figure 4:
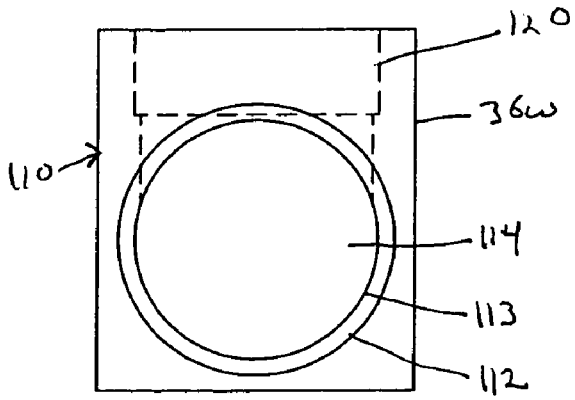
FIG. 4 is a front view of the outlet of FIG. 2.

Turning also to FIGS. 2–4, an outlet 24*k*, exemplary of all of the outlets 24*a*–24*o*, is now shown in detail. The outlet 24*k* includes a box 110, that terminates in a rim 112, for example, forming a port 113, for example, a circular shaped opening 114, configured to receive a correspondingly shaped ring 115 on a line, for example, line 88, formed of a hose or the like, for connecting to an apparatus (hair dryer 90 in the bedroom 36), as detailed above, or portion of an apparatus (as detailed above) in a frictional engagement. Alternately, the connection may be a mechanical locking connection, either alone or coupled with the frictional engagement. There may also be a mechanism in the rim 112, that when moved, for example, when the ring 115 of the hose 88 is received therein, activates a switch (not shown), for example, a low voltage switch, that activates the air warming and blowing unit 23 (either directly or through the controller 152), as detailed below. Other connections between the rim 112 and the ring 115 are suitable, provided the ring 115 will remain at least temporarily retained in the rim 112.

The box 110 receives an elbow tube 118 that couples the rim 112 with the conduit for delivering the warmed air, for example, the conduit 48*e*. The box 110 is anchored in the walls, for example walls 36*w* and 37*w*, by conventional fastening devices or systems. A cover 120 extends from the front of the box 110, and is hingedly attached to the box 110, by spring-biased hinges 122 (only one shown). The hinges 122 are spring biased, such that the cover 120 is normally in a closed position, covering the opening 114 of the rim 112.

When operation is desired, the cover 120 is lifted and the line 88 (or other tubular structure) is attached such that the ring 115 of the line 88 frictionally engages the rim 112 if the box 110. This engagement may also be a locking engagement (for example, a mechanical engagement).

The control device, for example, the remote controller 50, controlling the outlet, here, outlet 24*k*, may now be used to control the air temperature and air flow rate from the air warming and blowing unit 23. The cover 120, now in the open position, rests on the line 88, as shown in FIG. 2. Air flows through elbow tube 118 and out of the port 113 into the requisite line, for example, line 88, or other tubular carrier in the direction of the arrows 49'.

Alternately, the engagement of the ring 115 in the rim 112 may activate the low voltage switch (not shown), that will activate the air warming and blowing unit 23. The now activated air warming and blowing unit 23 will have the air temperature and air flow rate from it controlled by the control device for the particular outlet.

Still alternately, the engagement of the ring 115 in the rim 112 may activate the low voltage switch, that will activate the air warming and blowing unit 23. The air warming and blowing unit 23 delivers warmed air at a preset temperature and preset flow rate for the particular outlet. This can be either through a default setting or programmed into the controller 152 by the user, through any of the control devices.

The outlet 24*k*, as well as all other outlets 24*a*–24*j* and 24*l*–24*o*, typically include sensors (not shown), such as frictional (spring biased), light, or the like to detect whether the outlet is open or closed (the cover 120 is lifted or in an "up" position, or closed over the outlet opening in a "down" position). These sensors are typically electronically linked (wired, wireless or combinations thereof) to a control device, for example, the master remote controller 56, as detailed below, on which the open status for each of the outlets is typically indicated by an active light 222, for example, an illuminated light emitting diode (LED) (FIG. 9), detailed below. These sensors can also be connected to one or more switches, for example, low voltage switch(es), that function similarly to the switch (low voltage switch) for the frictional connection between the ring 115 and the rim 112, for activating the air warming and blowing unit 23, as detailed above.

Hoses are typically used in directly connecting various apparatus, detailed above, to the respective outlets. Similarly, hoses can be used to form the transport lines, over which the warmed air is transported, such as lines 62, 66, 82, 84, 88, and 88*a*. For example, hoses for connecting the respective apparatus to outlets, such as for the "direct connections" detailed above, may be 1.25 inch internal diameter hoses of thermoplastic rubber, such as medium weight Santoprene® thermoplastic rubber, reinforced with a spring steel wire helix rated to 275° F. These connector hoses are, for example, not more than approximately six feet (1.8 m) in length. Hoses used in the transport lines, such as lines 62, 66, 82, 84, 88, and 88*a*, for example, may be constructed similarly.

Figure 7:
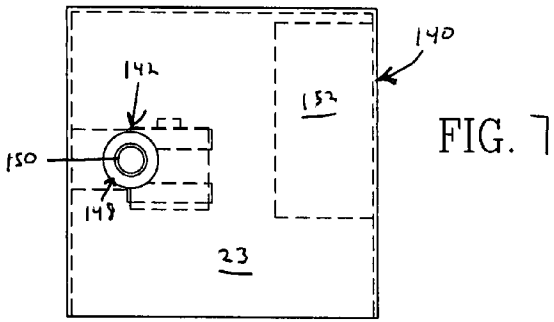
FIG. 7 is a top view of the air warming and blowing unit of FIGS. 5 and 6.
Figure 6:
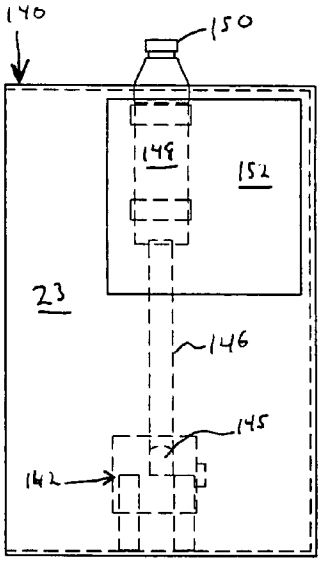
FIGS. 5 and 6 are side views of the air warming and blowing unit in accordance with an embodiment of the invention.
Figure 5:
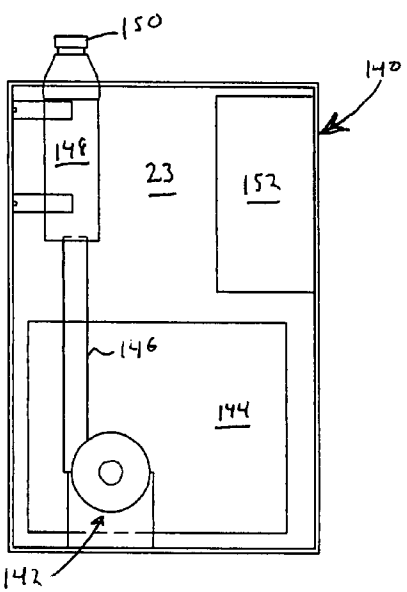

Turning also to FIGS. 5–7, there is detailed the air warming and blowing unit 23. This unit 23 includes a cabinet 140, that houses the components that produce and drive the warmed air, to deliver it to the desired outlet 24*a*–24*o* (at the desired temperature and flow rates). The components include a blower motor unit 142, having a motor and a fan (blower), whose air intake (where ambient air is taken into the blower motor unit 142) is coupled to an air filter unit 144, and blows air through an output duct 145 into a duct hose 146. The duct hose 146 is received by a heating element 148, whose neck 150 is coupled to the conduit 48*a* (FIG. 1).

The unit 23 also includes a controller 152, that is typically processor based (including one or more microprocessors, for example, Pentium® microprocessors, capable of running software programs). The controller 152, typically also includes control circuitry.

The controller 152 controls the blower motor unit 142 and the heating element 148, to produce the requisite warmed air for delivery to the requisite outlet 24*a*–24*o*, at the desired temperature and the desired flow rate. The controller 152 is electronically linked, by wired, wireless, or combinations of wired or wireless links, or combinations thereof, to the aforementioned control devices, to control air delivery, flow rate and temperature, to the outlets controlled by the specific control device or devices. The controller 152 can also perform timed shut off at the outlets 24*a*–24*o*.

The controller 152 is also electronically linked (by links that are wired, wireless or combinations thereof) to sensors (not shown) in the air warming and blowing unit 23, that detect air flow irregularities and clogged filters in the air warming and blowing unit 23. These sensors are monitored by the controller 152, that sends signals to the blower motor unit 142 (the blower motor) to shut down if a clog or other irregularity in the airflow is detected.

The cabinet 140 is typically made of stainless steel or the like, and is, for example, approximately 36 inches (approximately 91 cm) tall. The filter unit 144 includes at least one filter, similar to that found in residential furnace units. The filter unit 144 may be placed anywhere in the air flow path in or external to the cabinet 140.

The blower motor unit 142 includes a motor, that is, for example, a three speed motor, that coupled with the fan, produces output air flows (flow rates) ranging from approximately 40 to 80 cubic feet per minute (CFM), through a 2.047 inch (5.199 cm) internal diameter output duct. The blower motor unit 142 is such that it includes a pressure switch (not shown) that will shut down the blower motor unit 142 if all of the outlets 24*a*–24*o* are closed. Each outlet 24*a*–24*o*, typically has a sensor for detecting whether the outlet is open or closed and for reporting this condition to the controller 152, as detailed above. The controller 152 controls the pressure switch, based on the open/closed status of the outlet.

The heating element 148 provides tempered, typically warmed (heated) air, typically to approximately 180° F., with a preferred range for the heated air being approximately 90° F. to approximately 170° F. and approximately ±10° F. The blower motor unit 142 typically also includes an over temperature switch (not shown), either directly coupled to the heating element 148, or coupled to the heating element 148 through the controller 152. Power to the heating element 148 is deactivated when the temperature in the blower motor unit 142 reaches a predetermined threshold. This predetermined threshold may be, for example, at least 190° F.

As stated above, the controller 152 is electronically coupled to the blower motor unit 142 and the heating element 148. The controller 152 is also linked wirelessly to the remote controllers, such as the remote controller 50 or a master remote controller 56 (FIG. 9), and linked wired and/or wirelessly to fixed panel controllers, such as control panels 52*a*, 52*b* and master control panel 54. The controller 152 can run programs and perform functions for the air warming and blowing unit 23, in software, hardware or combinations thereof.

Figure 8:
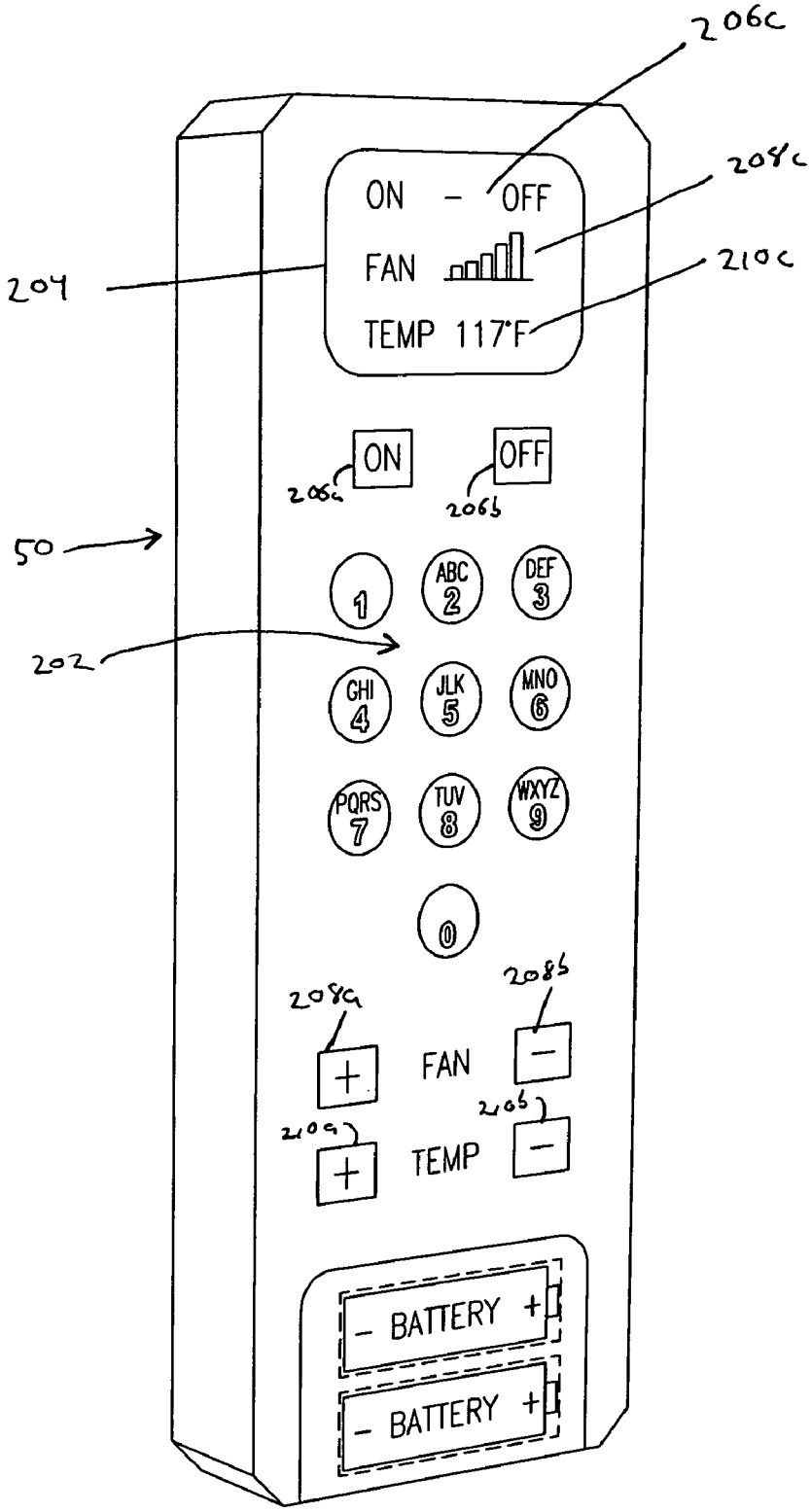
FIG. 8 is a perspective view of a remote controller in accordance with an embodiment of the invention.

FIG. 8 shows an exemplary remote controller, for example, the remote controller 50, electronically linked (wireless) to the controller 152. This remote controller 50 includes a key panel 202, with numerals and letters on each key, like those on a standard push button telephone, a screen 204, an ON/OFF buttons 206*a*, 206*b*, fan speed control buttons 208*a* (increase) 208*b* (decrease) and temperature control buttons 210*a* (increase) 210*b* (decrease). The screen 204 also includes sections for ON/OFF Status of the outlet 206*c* (air flowing through the outlet as controlled by the remote controller 50), fan speed 208*c*, and air temperature 210*c*. The fixed control panel, for example, control panels 52*a*, 52*b*, for controlling a single outlet, are similar to the remote controller 50, but may be wired to the controller 152.

Master control panel 54 is similar to the remote controller 50 of FIG. 8, but includes additional features, such as a buttons to activate specific outlets, master shut offs for components of the warm air blowing unit 23, interfaces with Transmission Control Protocol/Internet Protocol (TCP/IP) and other telephone, cable and network connections. As stated above, the master controller 54 is also electronically linked to the controller 152 by wired or wireless links, or combinations thereof. The screen is also such that the specific outlet or outlets being controlled appear on screen and there may be buttons or screen indicators, for example, LEDs, for the status (open-LED active or closed-LED inactive) of each individual outlet.

A master remote controller 56, as shown in FIG. 9, is similar to the remote controller 50, but includes the features of the master controller 54, including a screen position 220 for outlet number(s) being controlled at the present time, and lights (LEDs) or other visible indicia 222, indicating outlet status (open/closed). The master remote controller 56 is wirelessly linked to the controller 152, as well as wirelessly linked to networks, cellular, local and wide area networks, including the Internet. The remote controllers 50, 56 are typically battery powered and, for example, can measure approximately 2.5 inches (6.4 cm) by approximately 5 inches (12.7 cm) by approximately 0.75 inches (1.9 cm) deep, so as to be hand-held.

The above described air delivery system is exemplary only. As described above, the system 22 is particularly suitable for a 3000–8000 square foot house (residence) that is preferably new construction. While numerous outlets 24*a*–24*k* are shown, these are exemplary of the various outlets and apparatus that can be supported by the system 22. For example, the system 22 is such that it supports approximately ten outlets in the aforementioned house, with, for example, a maximum of two outlets open and being delivered air at any single time, and with the outlets preferably being not more than approximately 60 feet (approximately 18.3 meters) from the air warming and blowing unit 23, as through the respective conduits 48*a*–48*e*.

Alternately, the system 22 may be configured for blowing ambient temperature or cooled air. Still alternately, the air warming and blowing unit 23, although shown as a single unit, can be divided into two or more separate units.

While preferred embodiments of the present invention have been described, so as to enable one of skill in the art to practice the present invention, the preceding description is intended to be exemplary only. It should not be used to limit the scope of the invention, which should be determined by reference to the following claims.

What is claimed is:

1. A system for delivering warmed air in a structure comprising:

a unit for producing and driving warmed air from the unit;

at least one outlet for receiving the warmed air, the at least one outlet comprising a port configured to communicate with an apparatus via a flexible hose located in an interior space of a structure, wherein the flexible hose has a first end and a second end, the first end configured for being attachable and detachable with the port and the second end configured for being attachable and detachable with the apparatus that receives the warmed air; the at least one outlet further comprises a cover, which closes and covers the port when the flexible hose is removed from the port; and at least one conduit in communication with the warmed air producing unit and the at least one outlet, the at least one conduit configured for transporting the warmed air to the at least one outlet.

2. The system of claim 1, additionally comprising: an apparatus for communication with the second end of the flexible hose.

3. The system of claim 2, wherein the apparatus is selected from the group consisting of a food warmer, a pet bed warmer, a shoe dryer/warmer, a hair dryer, and a towel warmer.

4. The system of claim 1, wherein the unit for producing the warmed air is configured for producing warmed air at temperatures of approximately 80° F. to approximately 180° F.

5. The system of claim 1, wherein the unit for producing warmed air is configured to allow for the control of the temperature of the warmed air.

6. The system of claim 1, wherein the unit for producing warmed air is configured to allow for the control of the flow rate of the warmed air.

7. A system for delivering warmed air in a structure comprising:

a unit for blowing and tempering air at adjustable flow rates and temperatures;

at least one outlet for receiving the blown and tempered air, the at least one outlet comprising a port configured to communicate with an apparatus via a flexible hose located in an interior space of a structure, wherein the flexible hose has a first end and a second end, the first end configured for being attachable and detachable with the port and the second end configured for being attachable and detachable with the apparatus that receives the blown and tempered air; the at least one outlet further comprises a cover, which closes and covers the port when the flexible hose is removed from the port;

at least one conduit in communication with the air blowing and tempering unit and the at least one outlet, the at least one conduit configured for transporting the blown and tempered air from the air blowing and tempering unit to the at least one outlet; and a controller for controlling the air tempering and driving unit, the controller configured for being electronically linked to at least one control device for signaling the controller to control the air tempering and driving unit such that air is delivered to the at least one outlet at a temperature and a flow rate corresponding approximately to the air temperature and flow rate designated at the at least one control device.

8. The system of claim 7, additionally comprising: an apparatus for communication with the second end of the flexible hose.

9. The system of claim 8, wherein the apparatus is selected from the group consisting of a food warmer, a pet bed warmer, a shoe dryer/warmer, a hair dryer, and a towel warmer.

10. The system of claim 7, wherein the unit for producing the blown and tempered air includes a heater for warming the air.

11. The system of claim 10, wherein the heater for warming the air is configured for producing warmed air at temperatures of approximately 80° F. to approximately 180° F.

12. A method for delivering air to a remote location, comprising:

heating air to at least a predetermined temperature; and driving the heated air to at least one outlet at a predetermined flow rate, the at least one outlet comprising a port configured for communication with an apparatus via a flexible hose located in an interior space of a structure, wherein the flexible hose has a first end and a second end, the first end configured for being attachable and detachable with the port and the second end configured for being attachable and detachable with to apparatus that receives the heated air at least at approximately the predetermined flow rate and approximately the predetermined temperature; the at least one outlet further comprises a cover, which closes and covers the port when the flexible hose is removed from the port.

13. The method of claim 12, additionally comprising: placing an apparatus for receiving the heated air at least at approximately the predetermined flow rate and approximately the predetermined temperature into communication with the port.

14. The method of claim 12, wherein driving the heated air to at least one outlet at a predetermined flow rate includes controlling the flow rate of the heated air to at least approximately maintain the predetermined flow rate.

15. The method of claim 12, wherein heating the to at least a predetermined temperature includes controlling the heating such that the predetermined temperature is from approximately 80° F. to approximately 180° F.

16. The method of claim 12 wherein the at least one outlet includes a plurality of outlets.

17. The method of claim 12, performed in a single structure.

18. An air delivery system comprising:

a unit for producing tempered air and driving the tempered air out of the unit;

at least one outlet, wherein the outlet comprises a port configured to communicate with an apparatus via a flexible hose located in an interior space of a structure, wherein the flexible hose has a first end and a second end, the first end configured for being attachable and detachable with the port and the second end configured for being attachable and detachable with the apparatus; the at least one outlet further comprises a cover, which closes and covers the port when the flexible hose is removed from the port;

at least one conduit in communication with the air tempering and driving unit and the at least one outlet; and a wireless controller for controlling the air tempering and driving unit, the controller configured for being electronically linked to at least one control device for signaling the controller to control the air tempering and driving unit such that air is delivered to the at least one outlet at a temperature and a flow rate corresponding approximately to the air temperature and flow rate designated at the at least one control device.

19. The system of claim 18, additionally comprising: at least one control device, the at least one control device configured for controlling the air temperature and airflow rate to the at least one outlet.

20. The system of claim 19, wherein the at least one control device includes a remote control device.

21. The system of claim 19, wherein the at least one control device includes a control panel configured for being mounted to a structure.

22. The system of claim 18, additionally comprising: an apparatus for communication with the second end or the flexible hose.

23. The system of claim 22, wherein the apparatus is selected from the group consisting of a food warmer, a pet bed warmer, a shoe dryer/warmer, a hair dryer, and a towel warmer.

24. The system of claim 18, wherein the air tempering and driving unit includes a heater for warming the air.

25. The system of claim 24, wherein the heater for warming the air is configured for producing warmed air at temperatures of approximately 80° F. to approximately 180° F.

26. The system of claim 24, wherein the air tempering and driving unit includes a fan for driving the warmed air out of the unit and to the at least one outlet.

27. The system of claim 18, wherein the at least one outlet includes a plurality of outlets.

28. The system of claim 27, additionally comprising: at least one control device, the at least one control device configured for controlling the air temperature and airflow rate to at least one outlet of the plurality of outlets.

* * * * *